US007272864B2

(12) United States Patent
Grob et al.

(10) Patent No.: US 7,272,864 B2
(45) Date of Patent: Sep. 25, 2007

(54) FLUSHING FLOW DISTRIBUTOR FOR A FLUSHING CISTERN, FLUSHING SYSTEM HAVING A FLUSHING FLOW DISTRIBUTOR OF THIS TYPE AND TOILET SYSTEM HAVING A FLUSHING FLOW DISTRIBUTOR

(75) Inventors: Stefan Grob, Jona (CH); David Drexel, Kaltbrunn (CH); Abdullah Oengören, Sirnach (CH)

(73) Assignee: Geberit Technik AG, Jona (CH)

( * ) Notice: Subject to any disclaimer, the term of this patent is extended or adjusted under 35 U.S.C. 154(b) by 0 days.

(21) Appl. No.: 10/968,994

(22) Filed: Oct. 21, 2004

(65) Prior Publication Data

US 2005/0081284 A1 Apr. 21, 2005

(30) Foreign Application Priority Data

Oct. 21, 2003 (EP) ..... 03405761

(51) Int. Cl.
*E03D 3/10* (2006.01)

(52) U.S. Cl. ..... 4/354; 4/300; 4/368

(58) Field of Classification Search ..... 4/328, 4/332, 334, 336, 344, 354, 368, 421, 425, 4/374, 300

See application file for complete search history.

(56) References Cited

U.S. PATENT DOCUMENTS

| | | | | |
|---|---|---|---|---|
| 516,128 | A * | 3/1894 | Stifel | 4/344 |
| 887,850 | A * | 5/1908 | Rollins | 3/344 |
| 921,047 | A * | 5/1909 | Wilson et al. | 4/344 |
| 1,742,790 | A | 1/1930 | Smith | |
| 1,998,861 | A * | 4/1935 | Campus | 4/425 |
| 4,193,422 | A | 3/1980 | Rider | |
| 4,510,629 | A * | 4/1985 | Jovy et al. | 4/332 |
| 5,666,675 | A * | 9/1997 | Ruegg | 4/425 |
| 6,457,187 | B1 * | 10/2002 | Andersson et al. | 4/354 |
| 2002/0020009 | A1 * | 2/2002 | Vas et al. | 4/362 |

FOREIGN PATENT DOCUMENTS

| | | |
|---|---|---|
| DE | 21 16 375 A | 10/1972 |
| DE | 27 00 781 A | 7/1978 |
| FR | 2 740 794 A | 5/1997 |
| GB | 499321 A | 1/1939 |
| WO | WO98/39522 A1 | 9/1998 |

* cited by examiner

*Primary Examiner*—Tuan Nguyen
(74) *Attorney, Agent, or Firm*—Sughrue Mion Pllc.

(57) ABSTRACT

The flushing flow distributor has a first channel (21) which is to be connected to a discharge (45) of the flushing cistern (4), and a second and a third channel (24, 25, 69). The second channel (24) and the third channel (25) are in each case to be connected to a toilet bowl (10). The first channel (21) has a nozzle (17, 18, 19, 55, 62) which outputs the water to the two other channels (24, 25, 69). The nozzle (17, 18, 19, 55, 62) is preferably designed as a free jet nozzle. The flushing flow distributor is preferably designed as a pipe interrupter. It is preferably used on a pressurized flushing cistern (4) and permits flushing with less flushing water while at the same time requiring less space and with a flushing action which is at least ample.

12 Claims, 2 Drawing Sheets

FLUSHING FLOW DISTRIBUTOR FOR A FLUSHING CISTERN, FLUSHING SYSTEM HAVING A FLUSHING FLOW DISTRIBUTOR OF THIS TYPE AND TOILET SYSTEM HAVING A FLUSHING FLOW DISTRIBUTOR

FIELD OF THE INVENTION

The invention relates to a flushing flow distributor for a flushing cistern, having a first channel which is to be connected to a discharge of the flushing cistern, and a second and a third channel which are in each case to be connected to a toilet bowl and into which the water of the first channel is distributed during flushing.

BACKGROUND OF THE INVENTION

A flushing flow distributor of this type has been disclosed in the prior art, for example in DE 27 007 81 A. With this, the water in a conduit connected to a toilet bowl is divided in such a manner that some of the flushing water is supplied to a flushing channel of the toilet bowl and some of the water is supplied to a nozzle which is arranged in the siphon of the toilet bowl and, during flushing, brings about a thrust effect which enables the water level in the outflow channel to rise, as a result of which the content of the siphon is then sucked out. The water emerging from the flushing channel of the toilet bowl cleans the inside of the bowl. Therefore, during a flushing process, some of the water cleans the inside of the toilet bowl and some of the water accelerates the water in the siphon of the toilet bowl. In order to refill the emptied siphon after flushing, a storage pocket is provided which is filled with water during the flushing process via an outlet opening of a water conduit, the water then draining off towards the end of the flushing process and refilling the siphon. The abovementioned division of the water takes place in a conduit junction which is arranged in the toilet bowl above the storage pocket.

SUMMARY OF THE INVENTION

The invention is based on the object of providing a flushing flow distributor of the type mentioned which permits a flushing action which is at least ample and uses even less water.

The object is achieved with a flushing flow distributor of the generic type by the first channel outputting the water to the two other channels through a nozzle. The flushing flow distributor according to the invention permits an exact distribution of the water into the two channels connected downstream. In particular, the pressure in these two channels can thereby be set precisely. In addition, it is possible, by adjusting the nozzle, to set the division of the water flow into the two water flows connected downstream. The water which is to be distributed can therefore be supplied in a specific manner to the two channels, with the result that a good flushing action can be achieved with even less water.

The flushing flow distributor according to the invention is suitable in particular for a pressurized flushing cistern having a pressure tank in which the flushing water is stored under pressure. The flushing flow distributor according to the invention is suitable in particular for distributing water from a pressurized flushing tank of this type. The water from a pressurized flushing tank of this type can then be supplied directly to the conduit which leads to the nozzle in the siphon. The remaining water can then be used for flushing the flushing edge.

One particularly advantageous embodiment of the flushing flow distributor is produced if, according to a development of the invention, the nozzle is a free jet nozzle. This can be designed in a particularly simple manner such that the flushing flow distributor serves at the same time as a pipe interrupter. A pipe interrupter of this type prevents water from being sucked out of the toilet bowl into the supply conduit if there is a negative pressure in the supply conduit.

According to one development of the invention, the two channels connected downstream of the nozzle are arranged coaxially with each other. The nozzle is preferably likewise arranged coaxially with respect to these channels, specifically in such a manner that the water from this nozzle flows directly to an opening of the inner channel. This inner channel is then preferably connected to the nozzle of the siphon. As a result, a comparatively high pressure which enables an acceleration of the siphon water can be built up in this channel leading to the nozzle. The pressure and the distribution can be set in a simple manner by adjusting the nozzle in the axial direction.

According to a development of the invention, provision is made for the nozzle to have a conical orifice, and for a mouth of a channel arranged downstream to project into this conical orifice. This permits a distribution which can be set particularly precisely.

According to a development of the invention, the water from the nozzle is supplied to a pipe which has a funnel-shaped opening and is preferably designed as a diffuser. This makes it largely possible to prevent a pressure surge and in addition, by expansion of the water in the diffuser, enables an even higher pressure to build up.

The invention also relates to a flushing cistern having a flushing flow distributor according to the invention. The flushing cistern is preferably a pressurized flushing cistern with a pressure tank. The combination of this pressurized flushing cistern with the flushing flow distributor according to the invention permits particularly effective flushing with little water. In addition, the space required is particularly small, with the result that a flushing device requiring particularly little space can be produced.

The invention also relates to a toilet system having a flushing flow distributor according to the invention.

BRIEF DESCRIPTION OF THE DRAWINGS

Exemplary embodiments of the invention are explained in greater detail below with reference to the drawing, in which.

DETAILED DESCRIPTION OF THE EXEMPLARY EMBODIMENTS

Figure 1:
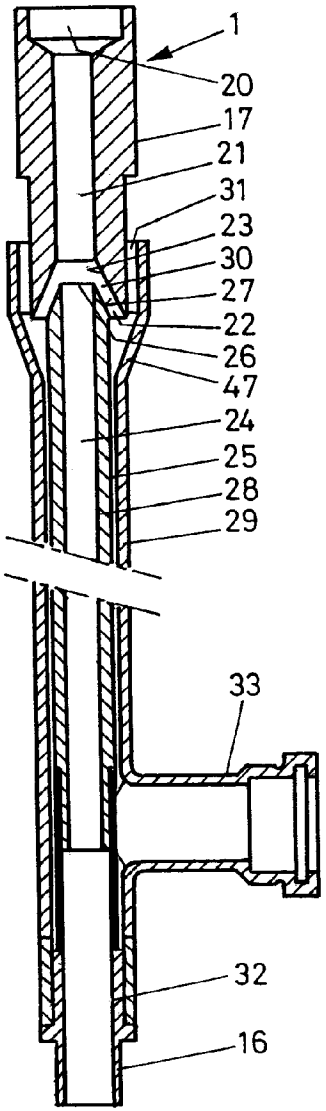
FIG. 1 shows a longitudinal section through a flushing flow distributor according to the invention.

The flushing flow distributor 1 shown in FIG. 1 has a nozzle 17 which is connected at a connection opening 20 to the discharge 45 of the pressurized flushing cistern 4 and which is preferably designed as a free jet nozzle. The nozzle 17 is designed as a cylindrical pipe section and has a first channel 21 which is to be essentially vertically aligned and connects the connection opening 20 to an opposite nozzle mouth 22. The mouth 22 has a conical surface 23 which, as can be seen in FIG. 1, extends and expands downwards.

Arranged below the nozzle 17 are two pipes 28 and 29 which are arranged co-axially with each other and which form an inner second channel 24 and a third outer channel 25. The second channel 24 is separated from the first channel 21 via a conical intermediate space 30 and likewise runs vertically and axially parallel to the first channel 21. The pipe 28 has an upper opening 26 which projects into the nozzle mouth 22 and is situated, according to FIG. 1, in the region of the conical surface 23. The opening 26 is surrounded on the outside by a conical surface 27 which runs essentially parallel to the conical surface 23. The nozzle 17 is preferably mounted in a manner such that it can be displaced vertically, so that the intermediate space 30 is enlarged or reduced in size.

The pipe 29 is connected at a lower end to the pipe 28 by means of a seal 32. The third channel 25 is therefore sealed off at the lower end of the pipe 29 from the outside of the pipe 28. However, the upper end of the pipe 29 is open to the ambient atmosphere at an encircling, annular opening 31. As can be seen, the pipe 29 has a collar-shaped region 47 which expands upwards in the shape of a funnel and into which the lower end of the nozzle 17 projects. The opening 26 of the pipe 28 is likewise situated in this region. A connector 33 which protrudes approximately at right angles and is to be connected to the flushing channel 11 is arranged in the lower region of the pipe 28.

Figure 2:
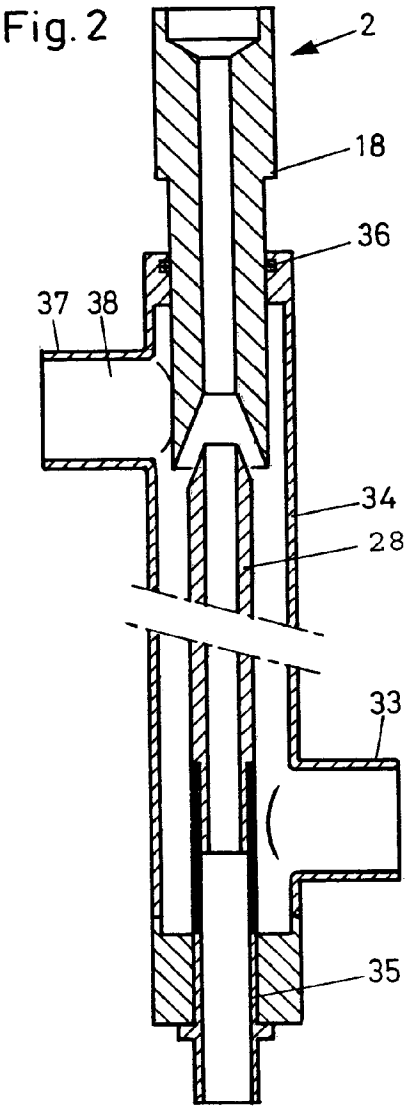
FIG. 2 shows a longitudinal section through a flushing flow distributor according to one variant.

The flushing flow distributor 2 shown in FIG. 2 has a nozzle 18 which is constructed in a similar manner to the nozzle 17 and which projects at its lower end into a pipe 34. The pipe 34 has at its upper end a vertically protruding connecting pipe 37 with an opening 38. This opening 38 corresponds in its function to the opening 31 and it therefore connects the interior of the pipe 34 to the ambient atmosphere. The pipe 34 is connected at its upper end to the nozzle 18 in a leakproof manner by means of a seal 36 and is connected at its lower end to the inner pipe 28 by a seal 35.

Figure 3:
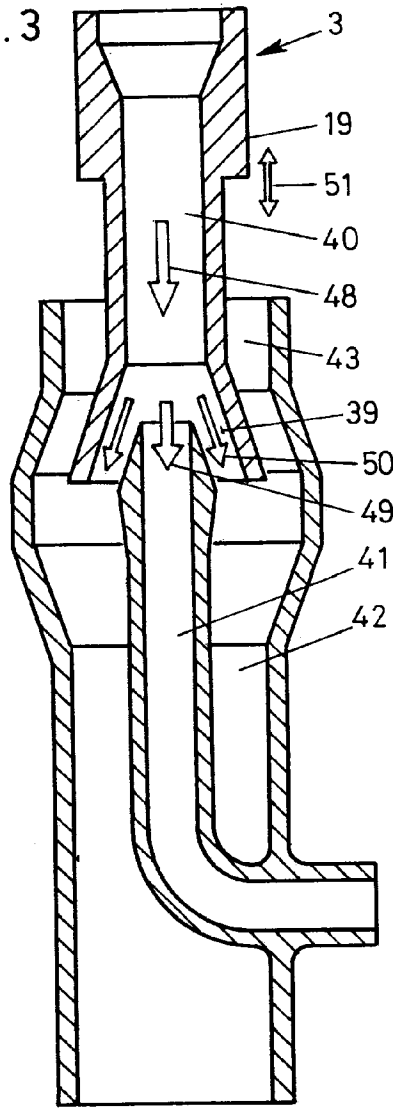
FIG. 3 shows schematically a longitudinal section through a flushing flow distributor according to a further variant.

FIG. 3 shows a flushing flow distributor 3 which likewise has a nozzle 19 with a lower mouth 39. This mouth 39 projects into a vent 43 which, as can be seen, is first of all widened in the shape of a funnel and is then contracted again. This opening 43 corresponds to the openings 31 and 38.

Figure 4:
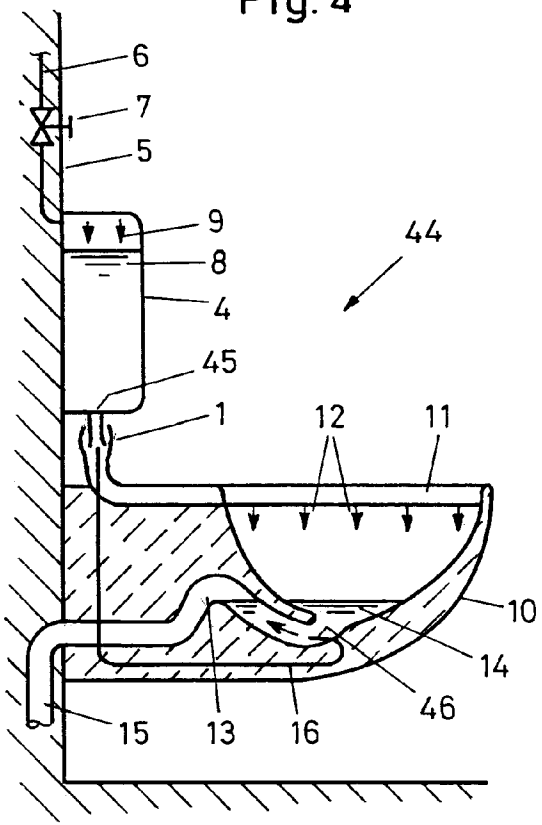
FIG. 4 shows schematically a toilet system according to the invention, and FIGS. 5+6 show longitudinal sections through flushing flow distributors according to further variants.

The toilet system 44 shown in FIG. 4 is fitted in front of a building wall 5 and is connected to a supply conduit 6 for fresh water, in which a shut-off valve 7 is arranged. Connected to the supply conduit 6 downstream of the shut-off valve 7 is a pressurized flushing cistern 4 in which a predetermined amount of water 8 is stored, above which there is a pressure space 9 containing air. Pressurized flushing cisterns 4 of this type are known per se, reference is made here, for example, to WO 98/39522. The pressurized flushing cistern 4 has a discharge 45 to which a flushing flow distributor 1 is connected. This flushing flow distributor 1 is preferably also designed as a pipe interrupter and prevents water from being sucked out of a toilet bowl 10 into the pressurized flushing cistern 4 and into the supply conduit 6 if there is a negative pressure in the pressurized flushing cistern 4 and in the supply conduit 6. The flushing flow distributor 1 distributes the water 8 of the pressurized flushing cistern 4 into at least two water flows, a first water flow passing into a "jet conduit" which has a jet nozzle 46 which is arranged in or in front of a siphon 13 of the toilet bowl 10. The nozzle 46 is situated in the water 14 with which a lower region of the toilet bowl 10 and the siphon 13 are filled. The second water flow passes into a flushing channel 11 of the toilet bowl 10 and passes downwards through openings (not shown here) in the directions of the arrows 12 and cleans the inside of the toilet bowl 10. A drain pipe 15 which leads into a waste disposal conduit (not shown here) is connected in a known manner to the siphon 13.

Figure 5:
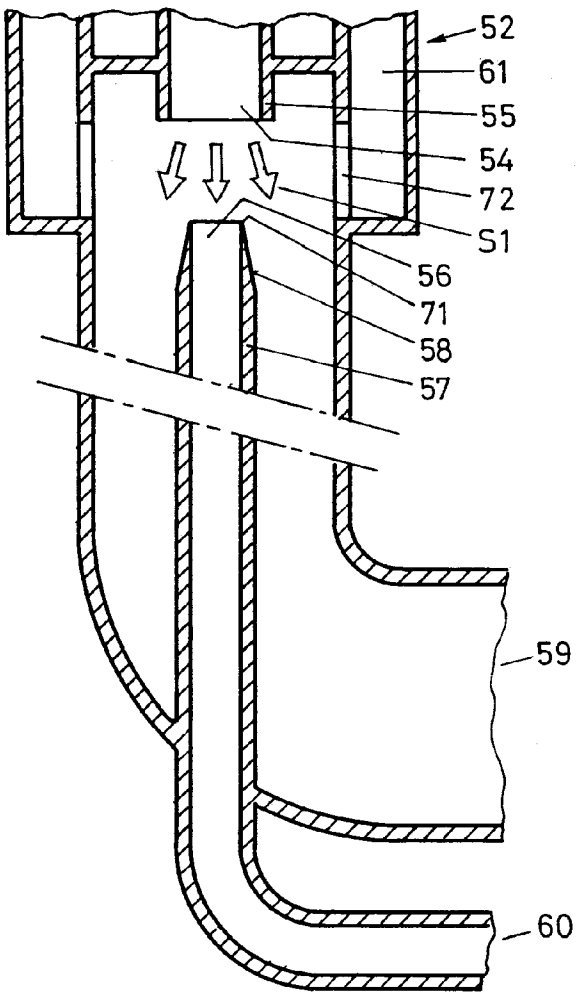

FIG. 5 shows a flushing flow distributor 52, in which a substantial clearance is provided between a mouth 54 of a nozzle 55 and an upper opening 56 of a pipe end 57 holding water, in which clearance a free jet S1 is formed. The pipe end 57 has a conical surface 58 on the outside, so that a comparatively sharp edge 71 is formed on the opening 56. Openings 72 are arranged laterally between the mouth 54 and the opening 56 and lead into an annular passage 61 which is open towards the ambient atmosphere. As a result, a particularly reliable pipe interrupter is formed in the event of negative pressure. The water flowing into a pipe 60 at the opening 56 passes to the jet nozzle 46 and the remaining water passes through a pipe 59 to the flushing channel 11.

Figure 6:
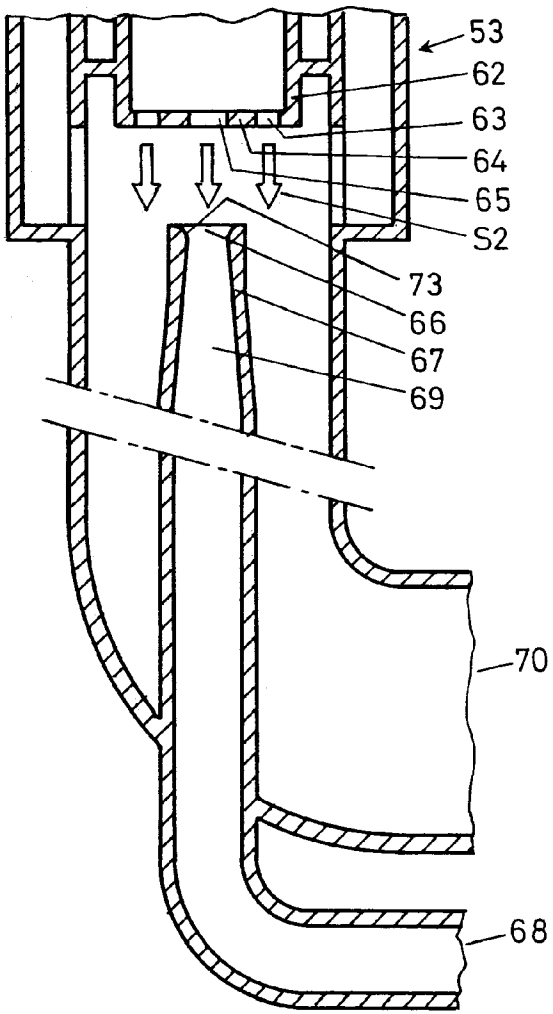

FIG. 6 shows a flushing flow distributor 53 in which a free jet S2 is likewise formed between a mouth of a nozzle 62 and an opening 66 of a pipe end 67. The mouth of the nozzle 62 is formed by a wall 64 which runs transversely with respect to the direction of flow and has a central opening 65 and a plurality of lateral openings 63. This wall 64 causes the water to be distributed as early as in the nozzle 62, some of the water flowing through a channel 69 of a pipe 68 to the jet nozzle 46 and some flowing through a pipe 70 to the flushing channel 11. As can be seen, the pipe end 67 has on the inside a surface 73 which expands outwards in the shape of a funnel, with the result that a funnel by means of which a pressure surge is prevented is formed in the opening 66. After the surface 73, the channel 69 becomes wider in its cross section, so that the pipe 68 forms a diffuser in which further pressure is built up by expansion. The design shown here of the pipe 68 avoids the abovementioned pressure surge during flushing and also increases the pressure in the channel 69. The required action of the jet nozzle 46 can therefore be achieved with even less water.

The manner of operation of the flushing flow distributors 1, 2, 3, 52, 53 is explained in greater detail below.

Flushing is triggered in the usual manner by an actuating device (not shown here). In the process, a discharge valve (not shown here) arranged in the pressurized flushing cistern 4 is opened. As a result, water under pressure flows through the discharge 45 into the flushing flow distributor 1, 2 or 3. According to FIG. 3, a first water flow 40 is thereby formed in the nozzle 19, the said water flow flowing vertically downwards at a comparatively high velocity to the mouth 39. In the region of this mouth 39, this first water flow 40 is divided into a second water flow 41 and a third water flow 42. The second water flow 41 is formed by the first water flow 40 flowing in directly, with the result that the initial direction of flow according to arrow 49 corresponds to the direction of flow of the first water flow 40 according to arrow 48. The third water flow 42 is formed by the remaining water of the first water flow 40 and runs downwards coaxially with the second water flow 41. In contrast to the second water flow 41, this third water flow 42 is formed by a lateral deflection of the water in the directions of the arrows 50. The first water flow 40 is distributed into the water flows 41 and 42 preferably in such a manner that the water volume of the third water flow 42 is substantially larger than, and preferably approximately twice as large as, the second water flow 41. In addition, the velocity of the second water flow 41 is preferably substantially higher than that of the third water flow 42. The second water flow 41 leads into the jet conduit 16 and finally to the nozzle 46. By contrast, the third water flow 42 leads into the flushing channel 11 and is therefore provided for cleaning the inside of the toilet bowl 10.

The nozzle 19 can be adjusted vertically preferably in the directions of the double arrow 51. As a result, the division of the two water flows 41 and 42 can be set precisely. If the nozzle 19 is moved downwards, then the third water flow 42 is reduced and the velocity of the second water flow 41 is increased. The outlet of water at the nozzle 46 can therefore be optimally set. The flushing of the toilet bowl 10 with the third water flow 42 can likewise be optimized and matched to the toilet bowl 10. Optimum cleaning of the toilet bowl 10 can therefore be achieved with minimal water consumption.

The first water flow 40 is divided as explained above into the two water flows 41 and 42. However, an embodiment is also conceivable, in which the water flow 40 is divided into more than two water flows. For example, a nozzle (not shown here) for cleaning the toilet bowl 10 could be supplied with a further water flow.

If a negative pressure arises in the pressurized flushing cistern 4 or in the supply conduit 6 due to a disturbance, then, for example in the case of the flushing flow distributor 3 according to FIG. 3, air is sucked in through the vent 43 and passes into the nozzle 19. As a result, the water flow in the nozzle 19 is interrupted and water cannot be sucked from the toilet bowl 10 into the pressurized flushing cistern and into the supply conduit 6. In the case of the flushing flow distributors 1 and 2, this function is fulfilled by the corresponding openings 31 and 38. The integration of the interrupter function in the flushing flow distributors 1, 2, 3, 52, 53 permits a very compact design which is also extremely functionally reliable.

LIST OF REFERENCE NUMBERS

1. Flushing flow distributor
2. Flushing flow distributor
3. Flushing flow distributor
4. Pressurized flushing cistern
5. Building wall
6. Supply conduit
7. Shut-off valve
8. Flushing water
9. Air space
10. Toilet bowl
11. Flushing channel
12. Arrow
13. Siphon
14. Water
15. Drain pipe
16. Jet conduit
17. Nozzle
18. Nozzle
19. Nozzle
20. Connection opening
21. First channel
22. Nozzle mouth
23. Conical surface
24. Second channel
25. Third channel
26. Opening
27. Conical surface
28. Pipe
29. Pipe
30. Intermediate space
31. Opening
32. Seal
33. Connector
34. Pipe
35. Seal
36. Seal
37. Connecting pipe
38. Opening
39. Mouth
40. First water flow
41. Second water flow
42. Third water flow
43. Vent
44. Toilet system
45. Discharge
46. Jet nozzle
47. Region
48. Arrow
49. Arrow
50. Arrow
51. Double arrow
52. Flushing flow distributor
53. Flushing flow distributor
54. Mouth
55. Nozzle
56. Opening
57. Pipe end
58. Surface
59. Pipe
60. Pipe
61. Passage
62. Nozzle
63. Opening
64. Wall
65. Opening
66. Opening
67. Pipe end
68. Pipe
69. Channel
70. Pipe
71. Edge
72. Opening
73. Surface
S1 Free jet
S2 Free jet

The invention claimed is:

1. A flushing flow distributor, connected to a pressurized flushing cistern having a pressure tank in which a predetermined amount of water is stored and a pressure space containing air disposed above the predetermined amount of water, said distributor having a first channel which is connected to a discharge of the pressurized flushing cistern, and having an outer channel and an inner channel, which are arranged coaxially with each other, and wherein the first channel distributes the water into the inner and outer channels during flushing, wherein the first channel outputs the water to the inner and outer channels through a nozzle, wherein water from the nozzle flows directly to an opening of the inner channel, wherein a comparatively high pressure can be built up in the inner channel, wherein the inner channel is provided for the connection of a jet nozzle which is arranged in a siphon of a toilet bowl, and the outer channel is provided for flushing the inside of a toilet bowl.

2. The flushing flow distributor according to claim 1, wherein the outer channel is at least partially defined by an inner surface of an outer pipe and an outer surface of an inner pipe, wherein an upper end of the outer pipe is provided with a connecting pipe having an opening for forming a pipe interrupter.

3. The flushing flow distributor according to claim 1, wherein the inner channel is arranged in a pipe which has an upper mouth which projects at least in some regions into a mouth of the nozzle.

4. The flushing flow distributor according to claim 1, wherein the nozzle has means for distributing the water into the inner and outer channels.

5. The flushing flow distributor according claim 4, wherein the means for distributing has a wall with a plurality of openings.

6. The flushing flow distributor according to claim 1, wherein the inner channel is formed in a pipe having an upwardly facing flannel-shaped inner surface at an upper end arranged below the nozzle.

7. The flushing flow distributor according to claim 6, wherein a cross section of the inner channel of the pipe increases below the funnel-shaped upper end to form a diffuser.

8. The flushing cistern having a flushing flow distributor according to claim 1, the flushing flow distributor is arranged in a discharge of the flushing cistern.

9. A toilet system having the flushing flow distributor according to claim 1, having a toilet bowl which has a flushing edge and the jet nozzle in the siphon of the toilet bowl, wherein the inner channel is connected to the jet nozzle and the outer channel is connected to the flushing edge.

10. The toilet system according to claim 9, wherein during flushing the flushing edge is supplied with approximately twice as much more water than the jet nozzle.

11. The toilet system according to claim 9 or 10, wherein the water supplied to the jet nozzle has a substantially higher pressure and higher velocity than the water supplied to the flushing edge.

12. The toilet system according to one of claims 9 or 10, wherein the flushing flow distributor is arranged between the flushing cistern and the toilet bowl.

* * * * *